US007926476B1

(12) United States Patent
Tentler et al.

(10) Patent No.: US 7,926,476 B1
(45) **Date of Patent: *Apr. 19, 2011**

(54) STRAP FOR BOW STRING RELEASE

(75) Inventors: Stephen M. Tentler, Fond du Lac, WI (US); Lynn A. Tentler, Cape Coral, FL (US)

(73) Assignee: Tru-Fire Corporation, North Pond du Lac, WI (US)

( * ) Notice: Subject to any disclaimer, the term of this patent is extended or adjusted under 35 U.S.C. 154(b) by 87 days.

This patent is subject to a terminal disclaimer.

(21) Appl. No.: 12/176,518

(22) Filed: Jul. 21, 2008

Related U.S. Application Data

(63) Continuation of application No. 10/662,989, filed on Sep. 15, 2003, now Pat. No. 7,422,008, which is a continuation of application No. 10/646,358, filed on Aug. 22, 2003, now abandoned.

(51) Int. Cl.
*F41B 5/18* (2006.01)

(52) U.S. Cl. ..... 124/35.2

(58) Field of Classification Search ..... 2/321, 322; 24/188, 189; 119/863, 864; 124/35.2; 224/164, 224/166, 221, 222, 267
See application file for complete search history.

(56) References Cited

U.S. PATENT DOCUMENTS 2,041,944 A 5/1936 Mestekin
2,394,856 A 2/1946 Hickman
2,420,435 A 5/1947 Lackow
2,440,728 A 5/1948 Siegal
2,449,885 A 9/1948 Domler
2,453,010 A 11/1948 Graffin
2,798,458 A 7/1957 Odermatt
2,929,372 A 3/1960 Vance
2,996,059 A 8/1961 Vance
3,004,532 A 10/1961 Vance
3,011,478 A 12/1961 Kirby
3,028,852 A 4/1962 Sutton, Jr.
3,072,115 A 1/1963 Johnson
3,604,407 A 9/1971 Wilson et al.
3,815,908 A 6/1974 Hashimoto
4,041,926 A 8/1977 Troncoso, Jr. et al.
4,047,250 A 9/1977 Norman
4,160,437 A 7/1979 Fletcher
4,193,135 A 3/1980 Rhee
4,403,594 A 9/1983 Todd
4,426,989 A 1/1984 Sutton
4,489,705 A 12/1984 Larson
4,509,497 A 4/1985 Garvison (Continued)

OTHER PUBLICATIONS

Article from website www.truefire.com entitled "Tru-Fire Releases Guide", Sep. 15, 2003, 2 pages.*

(Continued)

*Primary Examiner* — John Ricci
(74) *Attorney, Agent, or Firm* — Craig A. Fieschko, Esq.; DeWitt Ross & Stevens S.C.

(57) ABSTRACT

A strap for a bow string release is provided to form a semi-closed (or open) hand receiving condition wrist strap for facilitating quick attachment and detachment of the strap to the wrist. The strap facilitates one-handed coupling about an archer's wrist by selectively maintaining the semi-closed (or semi-open) hand receiving condition so that the archer does not have to manually insert a first end of the strap through a second end of the strap.

28 Claims, 5 Drawing Sheets

U.S. PATENT DOCUMENTS

| | | | | |
|---|---|---|---|---|
| 4,811,695 | A | 3/1989 | Higgins | |
| 4,831,997 | A | 5/1989 | Greene | |
| 4,909,232 | A | 3/1990 | Carella | |
| 4,938,487 | A | 7/1990 | Ponsart | |
| 4,958,758 | A | 9/1990 | Tipple et al. | |
| 4,969,448 | A | 11/1990 | Beyer | |
| 4,981,128 | A | 1/1991 | Garvison | |
| 5,014,689 | A | 5/1991 | Meunchen et al. | |
| 5,020,508 | A | 6/1991 | Greene, Jr. | |
| 5,261,581 | A | 11/1993 | Harden, Sr. | |
| 5,323,754 | A | 6/1994 | Pittman | |
| 5,595,167 | A | 1/1997 | Scott | |
| 5,615,662 | A | 4/1997 | Tentler et al. | |
| 5,785,010 | A | 7/1998 | Koch | |
| 5,857,452 | A | 1/1999 | Troncoso | |
| 6,125,833 | A | 10/2000 | Tentler et al. | |
| 6,129,055 | A | 10/2000 | Hanada | |
| 6,205,991 | B1 | 3/2001 | Summers et al. | |
| 6,253,753 | B1 | 7/2001 | Blum et al. | |
| 7,422,008 | B1 * | 9/2008 | Tentler et al. | 124/35.2 |

OTHER PUBLICATIONS

"T.R.U. Ball Release Products" catalog, 1996, p. 6.*
"HHA Sports 1997 Archery Catalog", 1997, pp. 8-9.*
"T.R.U. Ball Release Products" catalog, 1998, p. 4.*

* cited by examiner

STRAP FOR BOW STRING RELEASE

CROSS-REFERENCE TO RELATED APPLICATIONS

This application is a continuation under 35 USC §120 of U.S. application Ser. No. 10/662,989 filed Sep. 15, 2003 now U.S. Pat. No. 7,422,008 (the "second application"), which is itself a continuation under 35 USC §120 of U.S. application Ser. No. 10/646,358 filed Aug. 22, 2003 now abandoned (the "first application"). The entireties of these prior applications are incorporated by reference herein.

This application is also related to U.S. application Ser. No. 10/793,131 filed Mar. 4, 2004 (now U.S. Pat. No. 7,320,318, issued Jan. 22, 2008), which is itself a continuation-in-part under 35 USC §120 of the aforementioned second application (U.S. application Ser. No. 10/662,989 filed Sep. 15, 2003).

BACKGROUND OF THE INVENTION

The invention is generally related to bow string releases and is specifically directed to a strap for a release.

Bow string releases are well known in the industry. Typically, a bow string release is designed to engage and lock a bow string in a mechanical sear for allowing the archer to pull the bow to its maximum draw. A trigger mechanism is then used to unlock the sear mechanism and release the string to fire the arrow.

As is typical, most bow string releases are secured to the wrist of the archer, permitting the release to be held in an at ready position while freeing the fingers of the hand for other tasks. Also, by attaching the release to the archer at the wrist area, the amount of strain on the hand is greatly decreased when high draw weight bows are utilized, which is typical in archery hunting and archery tournaments. Many various straps and harnesses are available for bow string releases. An example of a widely accepted V-type strap is shown in U.S. Pat. No. 4,831,997 entitled: Wrist Strap, issued to Greene, on May 23, 1989. The strap has two ends that are placed around the wrist and then attached to secure the release strap and release to the wrist of the archer.

One mechanism to couple the strap about the archer's wrist is to provide a receiver on a first end of the strap. The archer then must manipulate the second end of the strap through the receiver, and then place a pin on the receiver through a hole provided on the second end of the strap, similar to operation of a belt worn around a waist.

Many currently available straps for bow string releases are difficult for the archer to couple about their wrist. This is because the strap remains proximal to the archer's shooting hand, preventing the archer from using their shooting hand to assist the archer's off-hand in manipulating the strap. It has proven difficult for archers to one-handedly manipulate the second end of the strap through the receiver, and then place the pin on the receiver through the hole provided on the second end of the strap.

Additionally, repeated placement of the pin on the receiver through the hole provided on the second end of the strap causes the hole to stretch during repeated drawing of the bow during use. This stretch causes the hole on the second end of the strap to disadvantageously expand.

SUMMARY OF THE INVENTION

This invention relates to an improved strap for a bow string release. According to preferred embodiments of the present invention, the strap has two ends, a first end and a second end.

The first end of the strap is provided with a receiver for receiving a tab that is coupled with the second end of the strap.

Preferably, the tab on the second end of the strap is sized to allow the archer to place the tab of the second end through the receiver of the first end of the strap, and have the tab of the second end selectively remain through the receiver of the first end of the strap. This allows the archer to have the ability to have the second end of the strap already started through the receiver of the first end of the strap, easing the way in which archers couple the strap to their wrist.

According to another aspect of the present invention, the strap is constructed in multi-layer fashion, a first padded layer that provides comfortable contact with the archer's skin, among other benefits, and a second non-stretchable layer that provides the strap with a robust design that prevents the strap from stretching, and prevents holes in the strap from expanding through repeated use, among other benefits.

DESCRIPTION OF THE PREFERRED EMBODIMENT

Although the disclosure hereof is detailed and exact to enable those skilled in the art to practice the invention, the physical embodiments herein disclosed merely exemplify the invention that may be embodied in other specific structure. While the preferred embodiment has been described, the details may be changed without departing from the invention, which is defined by the claims.

Figure 1:
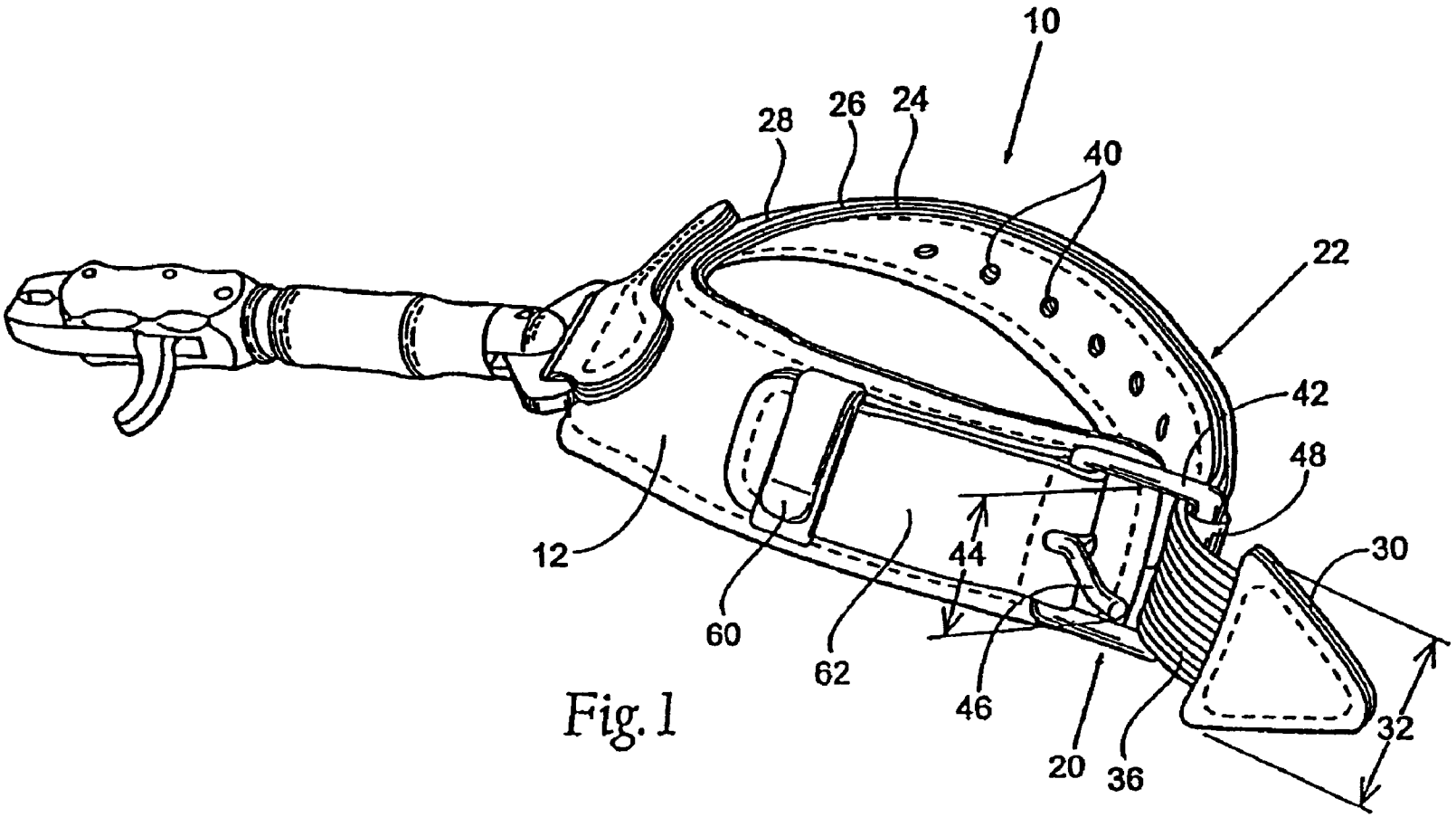
FIG. 1 is a perspective view of a preferred embodiment of a strap for a bow string release.

Referring now to FIG. 1, a perspective view of a preferred embodiment of a strap 12 for a bow string release 10 is shown. The strap 12 has two ends, a first end 20 and a second end 22. It is noted that reference to either the first end 20 or the second end 22 refers generally to the last segments of the strap 12, not to the absolute extremities of the strap 12. The first end of the strap 12 is provided with a receiver 42 for receiving a tab 30 that is coupled with the second end 22 of the strap 12.

Preferably, the tab on the second end 22 of the strap 12 is sized to allow the archer to place the tab 30 of the second end 22 through the receiver 42 of the first end 20 of the strap 12, and have the tab 30 of the second end 22 selectively remain through the receiver 42 of the first end 20 of the strap 12. This allows the archer to have the ability to have the second end 22 of the strap 12 already started through the receiver 42 of the first end 20 of the strap 12, easing the way in which archers couple the strap 12 to their wrist. It is understood that the first end may refer to either end of the strap, as long as the strap has two ends.

It is preferable to shape the tab 30 as a triangle, as shown, in order to ease folding of the tab 30 to fit through the receiver 42, although other shapes may be readily used.

The receiver 42 is coupled with a receiver pin 46 which can be inserted into holes 40 on the strap 12, belt fashion. The receiver 42 also preferably has a receiver roller 48 to facilitate sliding of the second end of the strap 22 through the receiver 42. It should be understood that other means for maintaining the second end 22 in a semi-closed position relative to said first end 20 may be used, such as a hook and loop attachment.

Still referring to FIG. 1, but also shown in FIGS. 2-6, according to another aspect of the present invention, the strap 12 is constructed in multi-layer fashion, a first preferably padded layer 24 that provides 15 comfortable contact with the archer's skin. A second non-stretchable layer 26 prevents the strap 12 from stretching, and also advantageously prevents holes 40 in the strap 12 from expanding through repeated use and placing of a pulling load on the holes 40 by a receiver pin 46. Preferably, the second layer 26 is formed with a nylon ballistic material. Optionally, a third layer 28 is provided on the outermost portion of the strap 12, the third layer 28 preferably formed from a material such as leather to give the strap 12 an appealing appearance. Common techniques for fabric coupling include sewing and adhesives, although any suitable coupling mechanism can be used.

The shape of the strap 12 is shown in a V-shaped pattern, although the strap 12 can take on other configurations to suit the archer's wrist.

Figure 2:
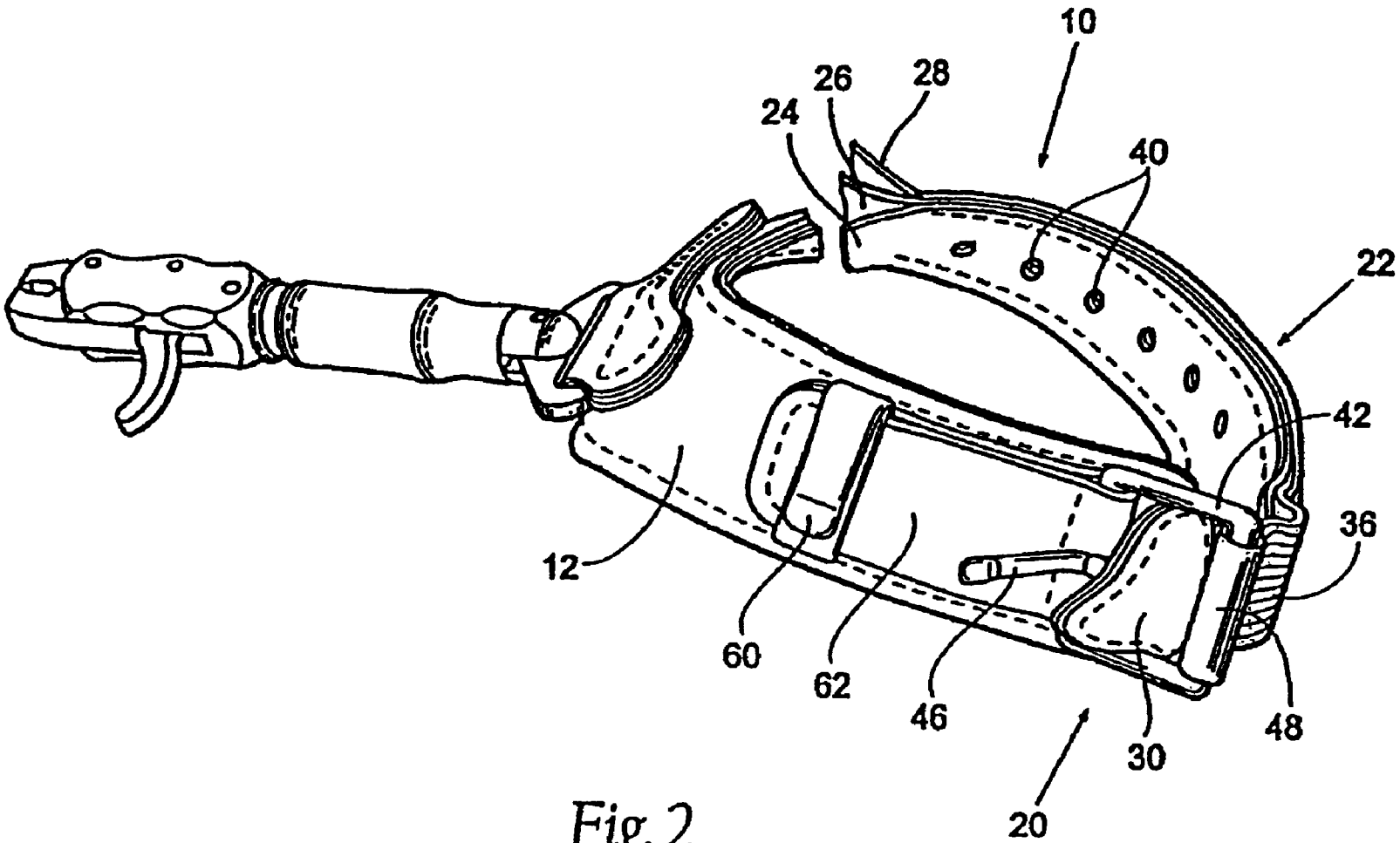
FIG. 2 is a perspective view of a preferred embodiment of a strap for a bow string release, the strap coupled about an archer's wrist, the strap in an open position.

Referring now to FIG. 2, the strap 12 is shown coupled about an archer's wrist, the strap 12 in an open position as shown. In this open position, the second end of the strap 22 has been withdrawn from the receiver 42 by flexing the tab 30 to decrease its effective width from its ordinary strap width 32, which is preferably greater than the width 44 of the receiver, until the strap width 32 is decreased by folding or otherwise, as shown in FIG. 2. It is believed that archers will prefer to keep the strap 12 in a semi-open position when the release is not in use, as described with relation to FIG. 1, in order to avoid having to manipulate the second end 22 of the strap 12 through the receiver 42.

Figure 3:
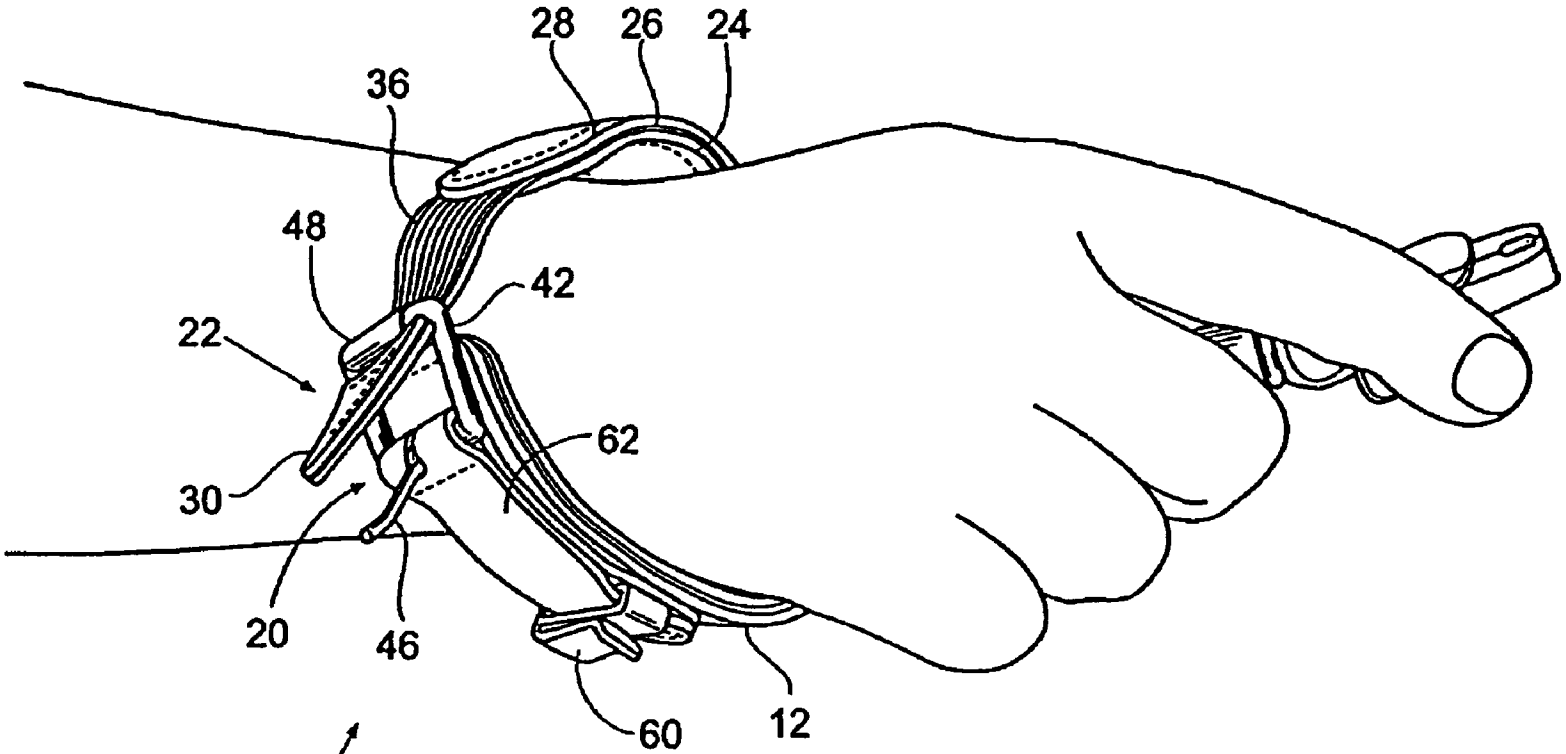
FIG. 3 is a perspective view of a preferred embodiment of a strap for a bow string release, the strap coupled about an archer's wrist, the strap in a semiclosed (or open) position.

Referring now to FIG. 3, the strap 12 is shown in a semi-open position. In this position, the archer has initially placed his wrist into the strap 12, but has not yet coupled the receiver pin 46 into any one of the holes 40 (not visible in FIG. 3).

Figure 4:
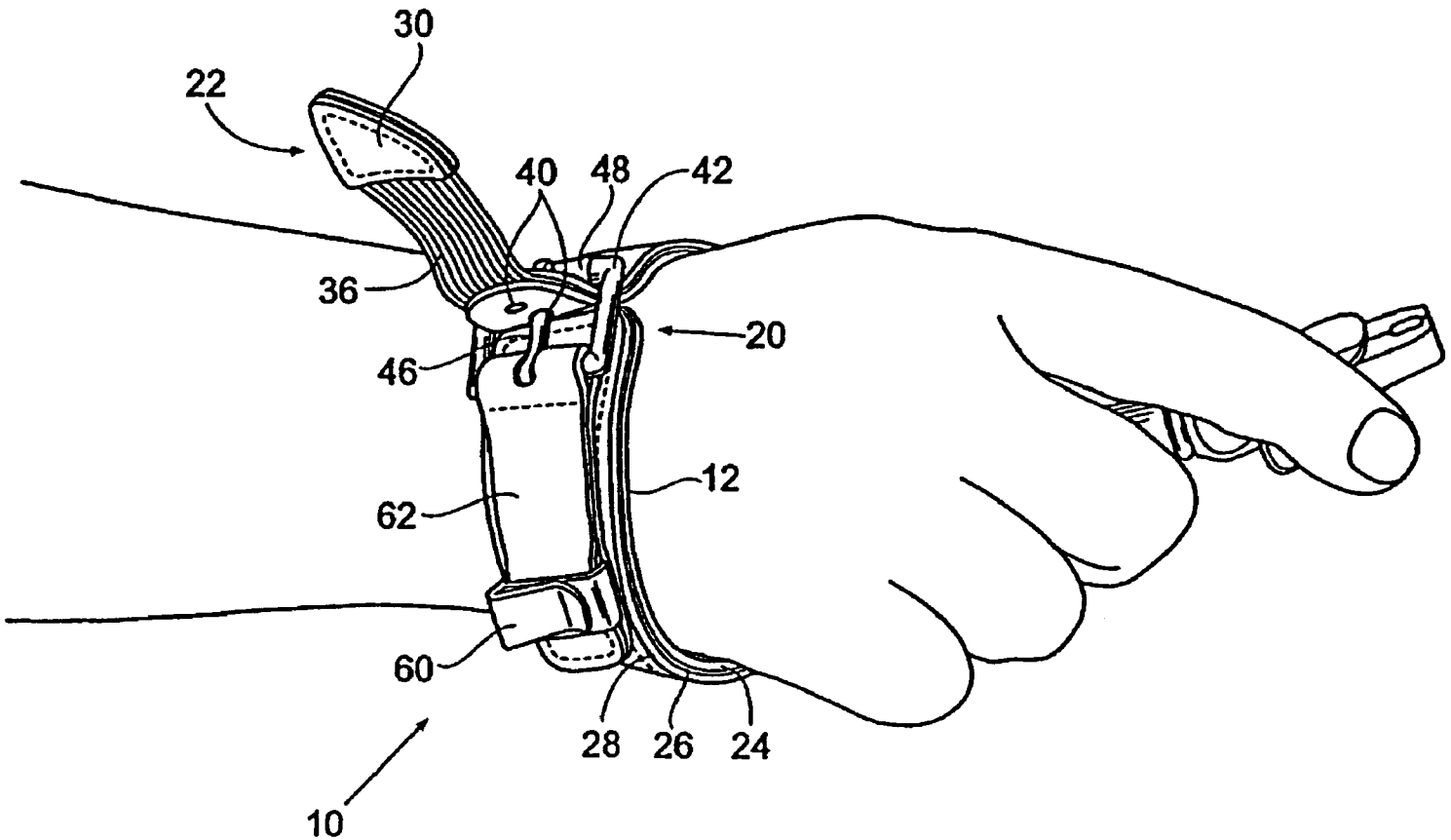
FIG. 4 is a perspective view of a preferred embodiment of a strap for a bow string release, the strap coupled about an archer's wrist, the strap in a closed position.

Referring now to FIG. 4, the strap 12 is shown in a closed position. In this position, the archer has initially placed his wrist into the strap 12, and has now coupled the receiver pin 46 into any one of the holes 40 to secure the strap about the wrist.

Figure 5:
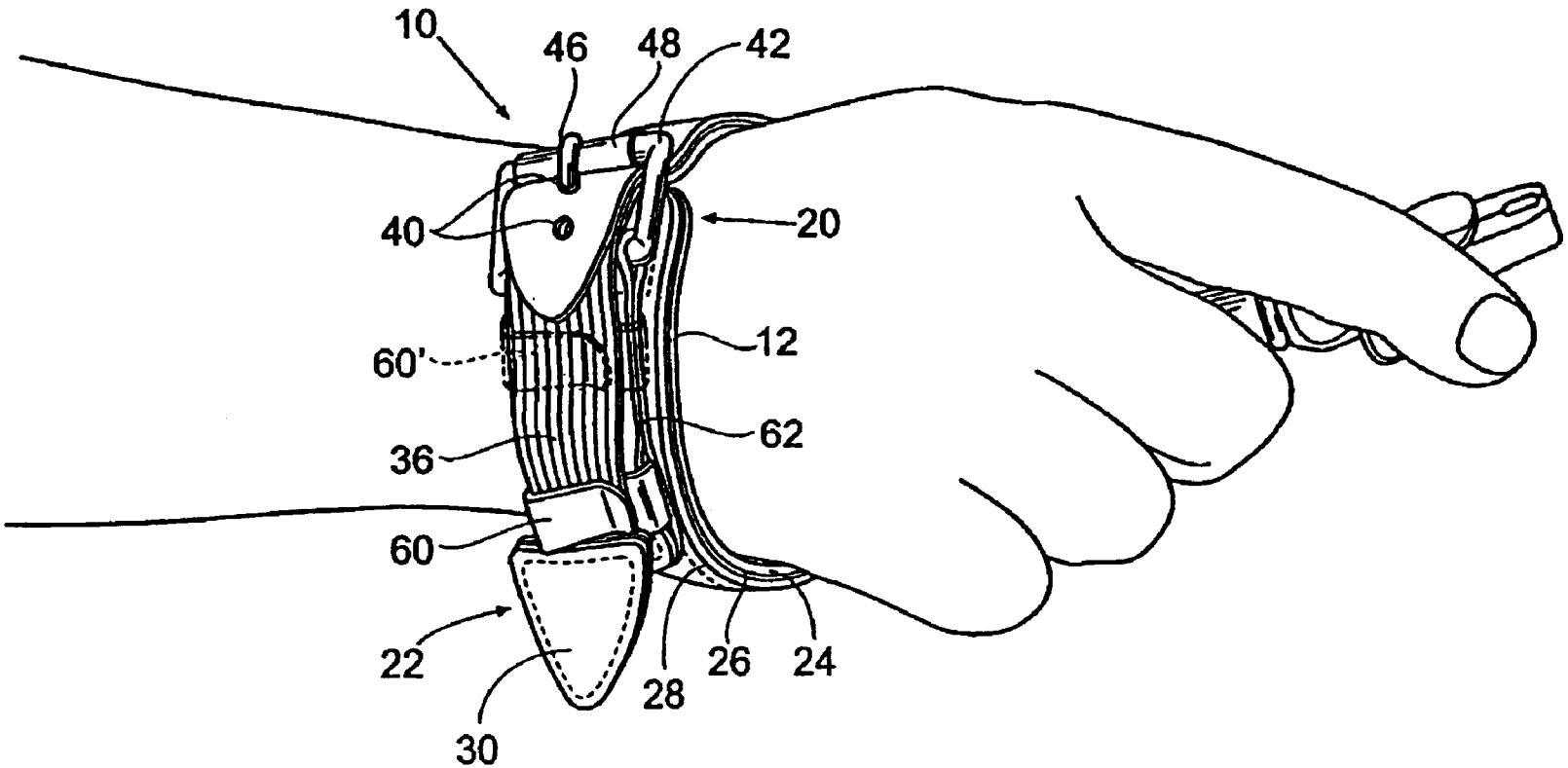
FIG. 5 is a perspective view of a preferred embodiment of a strap for a bow string release, the strap coupled about an archer's wrist, the strap in a closed position, and a tab of the strap in a restrained position.

Referring now to FIG. 5, the strap 12 is shown coupled about an archer's wrist, the strap in a closed position as described in relation to FIG. 5, and the tab 30 of the strap 12 in a restrained position. In this restrained condition, a portion of the second end of the strap 22, preferably the elastic member 36, has been placed into clip 60. The first end of the strap 20 has a clip 60 coupled to the strap 12 by a clip receiver strap 62. The clip receiver strap 62 preferably allows the clip 60 to slide laterally to engage the tab 30 for a wide variety of wrist sizes, and to keep the second end 30 of the strap 22 relatively secured to the strap 12 itself. The clip 60 is also shown in a second position 60' although the clip 60 preferably has the capability to slide along a range of lengths along the receiver strap 62. The elastic member 36 enables the second end of the strap 22 to be restrained, yet avoids the receiver pin 46 from being inadvertently withdrawn from a hole 40, as could be possible with an archer having a large wrist size.

It is understood that alternative embodiments of the present invention could also be employed to selectively maintain the second end 22 of the strap 12 through first end 20 of the strap, said alternative embodiments not shown in the drawings. This could be accomplished by having a piece of cord fasted to the 10 second end 22, and then weaving the cord through the receiver. Alternatively, an elastic member could be coupled with the first end 20, and then coupled with the second end 22.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. A bow string release strap having a length extending between first and second strap ends, wherein:

a. the first strap end bears a receiver through which the second strap end extends, thereby defining a loop wherein the size of the loop is adjustable in dependence on the extent to which the second strap end extends through the receiver;

b. the second strap end bears an oversized portion sized to avoid passage through the receiver, wherein the receiver is fit about the length of the strap between the oversized portion and the first strap end.

2. The bow string release strap of claim 1 further including a bow string grip affixed along the strap, the bow string grip allowing engagement and release of a bow string.

3. The bow string release strap of claim 1 wherein the oversized portion is resiliently flexible, and can be flexed to a size wherein it may pass through the receiver.

4. The bow string release strap of claim 1 wherein at least a portion of the length of the strap between the oversized portion and the first strap end is elastically extendable.

5. The bow string release strap of claim 1 wherein the length of the strap includes:

a. an elastically extendable portion near the oversized portion, and b. an inelastic portion extending between the elastically extendable portion and the first end.

6. The bow string release strap of claim 5 wherein the inelastic portion includes at least one of:

a. a series of spaced holes, each hole being situated to receive a receiver pin situated adjacent the receiver, and b. hook-and-loop fastener, whereby the inelastic portion may be fastened at or adjacent to the first end.

7. The bow string release strap of claim 1 wherein a portion of the length of the strap extending:

a. from the first strap end, b. at least substantially to the second strap end, is at least substantially inelastic.

8. The bow string release strap of claim 1 further including a clip slidably relocatable along the length of the strap between the first and second strap ends, the clip being configured to receive a portion of the length of the strap extending from the receiver.

9. A bow string release strap having a length extending between first and second strap ends, the strap defining a loop wherein:

a. the first strap end bears a receiver fit about the second strap end, whereby the receiver may be relocated along the second strap end, thereby resizing the interior of the loop;

b. the second strap end bears a member:

(1) situated such that at least a major portion of the length of the strap extends from the member, through the receiver, and toward the first strap end, (2) configured to interfere with the receiver, wherein the size of the loop may be expanded until the member interferes with the receiver, the strap being connected to a bow string grip, the bow string grip allowing engagement and release of a bow string.

10. The bow string release strap of claim 9 wherein the member is flexible, whereby the member may be bent to fit through the receiver to open the loop.

11. The bow string release strap of claim 9 wherein the length of the strap includes:

a. an elastic portion adjacent the member, and b. an inelastic portion extending from the elastic portion to the first end.

12. The bow string release strap of claim 11 wherein the inelastic portion includes means for fastening the inelastic portion to the first end.

13. The bow string release of claim 12 wherein the means for fastening the inelastic portion to the first end includes at least one of:

a. a series of spaced holes, each hole being situated to receive a receiver pin situated adjacent the receiver, and b. hook-and-loop fastener.

14. The bow string release strap of claim 9 further including a clip movable along the length of the strap adjacent the first strap end, the clip having a mouth into which the second strap end is closely received.

15. A bow string release strap having a length extending between first and second strap ends, wherein:

a. the first strap end bears a receiver riding along the length of the strap, whereby at least a portion of the length of the strap defines a resizable loop;

b. the second strap end bears a member interfering with the movement of the receiver along the length of the strap past the member, whereby the member halts the expansion of the loop, the strap being connected to a bow string grip, the bow string grip allowing engagement and release of a bow string.

16. The bow string release strap of claim 15 wherein the receiver:

a. is easily movable along the length of the strap prior to the member with the application of minimal force; and b. is movable past the member if significantly greater force is applied.

17. The bow string release strap of claim 15 wherein:

a. the receiver extends about the strap, with the strap fit within an interior receiver passage defined within the receiver;

b. the member has at least one dimension sized to interfere with the receiver during an attempt to urge the member through the interior receiver passage.

18. The bow string release strap of claim 17 wherein the member is resiliently deformable, whereby:

a. the member may be deformed with the application of force to fit through the interior receiver passage, and b. the member at least substantially returns to its original shape when the force is relieved.

19. The bow string release strap of claim 15 wherein the length of the strap adjacent the member is elastically extendible.

20. The bow string release strap of claim 19 wherein the length of the strap between the elastic length and the first end:

a. is at least substantially inelastic, and b. includes means for fastening to the first end.

21. The bow string release strap of claim 15 further including a clip movable along the length of the strap adjacent the first strap end, the clip receiving the second strap end to hold it closely adjacent the length of the strap adjacent the first strap end.

22. A bow string release strap having a length extending between first and second strap ends, the strap defining a closed loop wherein the first strap end is slidably fixed along the length of the strap, with:

a. the loop reducing in size as the first strap end is moved away from the second strap end, and b. the loop increasing in size as the first strap end is moved toward the second strap end, and c. the second strap end bearing a member halting further increase in size of the loop when the member encounters the first strap end, the strap being connected to a bow string grip, the bow string grip allowing engagement and release of a bow string.

23. The bow string release strap of claim 22 wherein the second strap end bears a receiver through which the length of the strap slides.

24. The bow string release strap of claim 23 wherein the member is sized to interfere with the receiver during an attempt to slide the member through the receiver.

25. The bow string release strap of claim 23 wherein the member:

a. is normally sized to interfere with the receiver during an attempt to slide the member through the receiver, and b. is deformable to a size fitting through the receiver.

26. The bow string release strap of claim 22 wherein at least a portion of the second strap end may be elastically extended to move the member away from the first strap end along the length of the strap.

27. The bow string release strap of claim 26 wherein the length of the strap between the first strap end and the elastic portion:

a. includes means for fastening to the first end, and b. is at least substantially inelastic.

28. The bow string release strap of claim 22 further including a clip movable along the length of the strap adjacent the first strap end, the clip having a mouth into which the second strap end is closely received.

* * * * *